United States Patent [19]

Malec

[11] 3,957,746

[45] May 18, 1976

[54] PHOSPHO-SULFURIZED PHENOLIC ALDEHYDE AMINE ALKYLENE OXIDE CONDENSATION PRODUCT

[75] Inventor: Robert E. Malec, Birmingham, Mich.

[73] Assignee: Ethyl Corporation, Richmond, Va.

[22] Filed: Oct. 4, 1974

[21] Appl. No.: 512,363

[52] U.S. Cl. ..... 260/125; 252/46.7; 260/137; 260/132; 260/128; 260/136; 260/981

[51] Int. Cl.[2] ..... C09B 49/00

[58] Field of Search ..... 260/125, 137, 132, 128, 260/136, 981; 252/46.7

[56] References Cited

UNITED STATES PATENTS 3,214,423 10/1965 Zech et al. ..... 260/137

3,389,086 6/1968 Reed et al. ..... 260/128

*Primary Examiner*—Lewis Gotts
*Assistant Examiner*—D. R. Phillips
*Attorney, Agent, or Firm*—Donald L. Johnson; Robert A. Linn; Joseph D. Odenweller

[57] ABSTRACT

A dispersant-antiwear lubricating oil additive is made by reacting a high molecular weight hydrocarbon-substituted phenol with aldehyde and ammonia or amines having a reactive hydrogen atom to form a Mannich condensation product which is reacted with an alkylene oxide and $P_2S_5$ to form the additive.

27 Claims, No Drawings

PHOSPHO-SULFURIZED PHENOLIC ALDEHYDE AMINE ALKYLENE OXIDE CONDENSATION PRODUCT

BACKGROUND

Mannich condensation products of high molecular weight hydrocarbon-substituted phenols, aldehydes and reactive amines are known detergent-dispersants in lubricating oil and liquid hydrocarbon fuels. Their preparation and use are described in Otto, U.S. Pat. Nos. 3,368,972 and 3,649,229; Worrel, U.S. Pat. No. 3,413,374; and Piasek et al, U.S. Pat. Nos. 3,539,633 and 3,798,165. In application Ser. No. 467,051, filed May 6, 1974, I described the reaction product formed by reacting such Mannich condensation products with alkylene oxides which exhibit less bearing corrosion when used in lubricating oil.

SUMMARY OF THE INVENTION

According to the present invention, additives are obtained having excellent dispersant and antiwear properties in lubricating oil by reacting a high molecular weight (over 650) hydrocarbon-substituted phenol with aldehyde and ammonia or an amine having a reactive hydrogen atom to form a condensation product which is then reacted with alkylene oxide and $P_2S_5$.

DESCRIPTION OF THE PREFERRED EMBODIMENTS

A preferred embodiment of the invention is an additive having dispersancy and antiwear properties in lubricating oils, said additive being made by the process comprising:

A. reacting one mole part of an aliphatic hydrocarbon-substituted phenol wherein said hydrocarbon substituent has an average molecular weight of from about 650 to 5000 with from about 1–10 mole parts of a $C_{1-4}$ aldehyde and from about 0.1–10 mole parts of a nitrogen compound, said nitrogen compound being selected from the group consisting of ammonia and amines containing at least one HN< group and containing from 1 to about 20 carbon atoms to form a Mannich condensation product, B. reacting said condensation product with about 0.1–50 mole parts of an alkylene oxide containing from 2 to about 6 carbon atoms to form an alkoxylated product, and C. reacting said alkoxylated product with about 0.05 to 1 mole part of $P_2S_5$ to form said additive.

Representative high molecular weight aliphatic hydrocarbon-substituted phenols useful in this invention can be prepared by reacting phenol with a polyolefin having an $\overline{M}n$ of about 650 to about 100,000, and more preferably about 650 to about 5,000, using a $BF_3$ catalyst in the form of a phenate. The starting phenol may be substituted with such groups as alkyl, aryl, halogen, mercapto, and the like, and may be a bridged phenol such as methylene, sulfide or oxide-bridged phenols as long as there are reactive ortho or para positions available to enter into a Mannich condensation. A highly preferred polyolefin substituent has an $\overline{M}n$ of about 850–1500. The most useful polyolefins are the homopolymers and copolymers of lower monoolefins such as ethylene, propylene and isobutylene. Thus, useful aliphatic hydrocarbon substituents include polyethylene, polypropylene and polybutene substituents having an $\overline{M}n$ of about 650 to 100,000, and preferably 650 to about 5000. Useful copolymer substituents include ethylene-propylene copolymers, ethylene-propylene-isobutylene terpolymer, ethylene-isobutylene copolymer, propylene-isobutylene copolymer, and the like. The most preferred hydrocarbon-substituted phenols are polybutene and polypropylene-substituted phenols.

The aliphatic hydrocarbon substituent is substantially saturated but may contain a small amount, up to about 5 percent, of unsaturated carbon-carbon bonds. These occur when the polyolefin substituent is derived from a mixture of lower olefins containing a small amount of diene, such as 1,3-butadiene, 2-methyl-1,3-butadiene, and the like. Also, small amounts of non-hydrocarbon substituents on the aliphatic substituent, such as mercapto, sulfide, di-sulfide, hydroxide, chloride, and the like, not in excess of about 5 percent of the hydrocarbon substituent, which do not detract from the essential hydrocarbon character of the substituent are not detrimental.

Useful aldehydes include formaldehyde, acetaldehyde, propionaldehyde, butyraldehyde, isobutyralehyde, and the like. The most preferred aldehyde is formaldehyde, including formaldehyde-forming materials such as paraformaldehyde.

Ammonia or any of a broad range of amines can be used as the nitrogen compound. All that is required is that the amine contain at least one HN< group such that it can enter into the well-known Mannich condensation reaction. Such amines may contain only primary amino groups, only secondary amino groups, or both primary and secondary amino groups. Typical amines are the polyalkyl polyamines, ethylene diamine, propylene diamine, polyalkylene polyamines, aromatic amines including o-, m- and p- phenylene diamines, diamino naphthalenes, and acid-substituted polyalkylene polyamines such as N-acetyltetraethylenepentamine and the corresponding formyl-, propionyl-, butyryl, and the like, N-substituted compounds. Also included are cyclized compounds formed therefrom such as the N-alkyl amines of imidazolidine and pyrimidine. Secondary heterocyclic amines which are suitable are those characterized by attachment of a hydrogen atom to a nitrogen atom in the heterocyclic group. Representatives of cyclic amines contemplated are morpholine, thiomorpholine, pyrrole, pyrroline, pyrrolidine, indole, pyrazole, pyrazoline, pyrazolidine, imidazole, imidazoline, imidazolidine, piperidine, piperazine, phenoxazine, phenthiazine, and their substituted analogs. Substituent groups attached to the carbon atoms of these amines are typically alkyl, aryl, alkaryl, aralkyl, cycloalkyl, and amino compounds referred to above.

Although amines containing a large hydrocarbon group are useful, such as polypropylene ($\overline{M}n$ 1000) amine, polybutene ($\overline{M}n$ 1200) amine, N-polypropylene ($\overline{M}n$ 900) ethylene diamine, N-polybutylene ($\overline{M}n$ 1500) ethylene diamine, the preferred amines contain at least one reactive amine hydrogen atom and from 1 to about 20 carbon atoms. Illustrative examples of these include methyl amine, dimethyl amine, ethyl amine, diethyl amine, N-propyl amine, isobutyl amine, N-hexyl amine, 2-ethylhexyl amine, N-decyl amine, N-dodecyl amine, N-eicosyl amine, ethylenediamine, 1,3-propanediamine, tetraethylenepentamine, 1,6-hexanediamine, piperidine, piperazine, cyclohexyl amine, aniline, phenylenediamine, N-isopropyl phenylenediamine, and the like.

A highly preferred class of amine reactants are the alkylene polyamines which have the formula $H_2N(R_1-NH)_nH$ wherein $n$ is an integer from 1 to about 6 and $R_1$ is a divalent hydrocarbon group containing 2 to about 4 carbon atoms. These compounds and their method of preparation are discussed at length in Kirk-Othmer, *Encyclopedia of Chemical Technology*, Vol. 5, pp. 898–9, Interscience Publishers, Inc., New York. These include the series ethylene diamine, diethylenetriamine, triethylenetetramine, tetraethylenepentamine, pentaethylenehexamine, and the like. Of these alkylene polyamines, a highly preferred reactant is tetraethylenepentamine or a mixture containing mainly tetraethylenepentamine or having an average composition corresponding to tetraethylenepentamine. Such a material is commercially available from Carbide Chemical Company under the tradename "Polyamine H". Another highly preferred alkylene polyamine is diethylenetriamine or a mixture of alkylene polyamines having an average composition corresponding substantially to diethylenetriamine. Corresponding propylene polyamines such as propylenediamine, dipropylenetriamine, tripropylenetetramine, tetrapropylenepentamine, and the like, are also suitable. These alkylene polyamines are readily obtained by the reaction of ammonia with dihalo alkanes such as dichloro alkanes.

Also suitable are condensation products of urea or thiourea and the alkylene polyamines wherein for each mole part of urea or thiourea two mole parts of alkylenepolyamine are used.

Another preferred class of amine reactants is the N,N-dialkyl alkane diamines. These compounds have the formula:

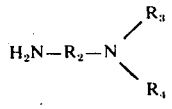

wherein $R_2$ is a divalent lower alkane group containing 2 to about 6 carbon atoms and $R_3$ and $R_4$ are independently selected from $C_{1-4}$ alkyl groups. Representative examples include N,N-dimethyl-1,3-propanediamine, N,N-diethyl-1,2-ethanediamine, N,N-di-n-butyl-1,6-hexanediamine, and the like.

Another useful class of amine reactants is the alkanol amines. These are primary or secondary amines having at least one alkanol group bonded to the amine nitrogen atom. The alkanol groups contain from 2 to about 6 carbon atoms. These compounds can be represented by the formula:

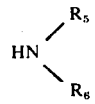

wherein $R_5$ is an alkanol group preferably containing 2 to about 6 carbon atpms and $R_6$ is selected from hydrogen, lower alkyls containing 1–4 carbon atoms, and alkanol groups containing 2–6 carbon atoms. Representative examples are ethanol amine, diethanol amine, ethanol methyl amine, hexanol amine, dihexanol amine, and the like. Of these, the preferred amines are the ethanol amines such as diethanol amine.

Alkylene oxides include those containing from 2 to about 6 carbon atoms, such as ethylene oxide, propylene oxide, 1,2-butene oxide, isobutylene oxide, 1,2-hexene oxide, and the like.

The preferred ratio of reactants used in making the initial condensation product is one mole part of hydrocarbon-substituted phenol:1-10 mole parts of aldehyde:0.1-10 mole parts of ammonia or amine. The amount of alkylene oxide used is about 0.1–50 mole parts.

The reaction temperature of the condensation stage can vary over a wide range. All that is required is that the temperature be high enough to cause the reaction to proceed at a reasonable rate, but not so high as to cause thermal decomposition. A useful temperature range is from about 50° to 250°C. Frequently the initial portion of the reaction is conducted at the lower end of this temperature range and the mixture is gradually heated to over 100°C towards the end to distill out water formed during the reaction. The reaction with alkylene oxide proceeds readily at temperatures as low as 25°C and lower, although a preferred temperature range for this part of the reaction is from about 50° to 200°C.

The reactants can be combined by various methods. The hydrocarbon-substituted phenol, aldehyde and amine can be initially reacted and the alkylene oxide reaction conducted in a second step. Alternatively, the alkylene oxide may be reacted with the hydrocarbon-substituted phenol and the resultant product reacted with aldehyde and ammonia or amine. Good results are also obtained by initially reacting the hydrocarbon-substituted phenol with aldehyde and then reacting the mixture with ammonia or amine and finally reacting the product with the alkylene oxide. The most preferred method of preparing the reaction product is to first react the hydrocarbon-substituted phenol, aldehyde and ammonia or amine in any sequence, or all at once, and then in a later step to react the alkylene oxide with the first obtained Mannich condensation product to form an alkoxylated product.

The Mannich condensation reaction is usually complete in about 1–8 hours. Preferably, the condensation product is water washed to remove any unreacted amine and aldehyde. It is then dried and the alkoxylation conducted by adding alkylene oxide to it, or bubbling alkylene oxide through it, until the desired amount reacts. The alkoxylation is preferably conducted in a closed system or one fitted with a low temperature condenser to avoid loss of any volatile alkylene oxide. Alkoxylation is generally adequate after reacting for about 1 to 4 hours.

The phosphosulfurization reaction can be conducted by adding solid powdered or lump-form $P_2S_5$ to the alkoxylated condensation product and stirring at reaction temperature for a period of time sufficient to introduce enough phosphorus and sulfur to impart antiwear properties. Only small amounts required; for example, from 0.01–10 percent sulfur and 0.01–10 percent phosphorus. A reaction temperature of 50° to 200°C is satisfactory, and a temperature range of 80° to 100°C is preferred. The degree of reaction is generally adequate after a period of about 2 to 6 hours. Any excess $P_2S_5$ can be removed by filtration. Preferably, the final additive is water washed and dried.

The additive is generally used in the form of a concentrate containing about 50–75 percent additive and the remainder diluent oil. This improves handling properties.

The following examples illustrate the manner in which the additives are made.

EXAMPLE 1

Alkylation

In a reaction vessel was placed 920 grams of polybutene (average molecular weight 950), 169 grams of phenol and 500 grams of SAE-7 diluent mineral oil. This was stirred and heated under nitrogen to 45°C, at which time 40 grams of $BF_3 \cdot 2$ phenol complex was added. The mixture was stirred at 50°–55°C for 1.5 hours and then water washed. It was dried by heating to 185°C under vacuum.

Mannich Condensation

To the resultant polybutene-substituted phenol was added 52 grams of diethylenetriamine while stirring under nitrogen. The mixture was heated to 45°C and 36 grams of paraformaldehyde was added. The mixture was stirred for 7 hours while slowly heating to 180°C. Water which formed during the condensation was continuously distilled out. During the last 1.5 hours of the reaction water aspirator vacuum was applied to aid in water removal. Following the reaction an additional 27 grams of diluent oil was added to give a 66 percent concentration of Mannich condensation product in diluent mineral oil.

Alkoxylation

A 502 gram portion of the above condensation product was placed in a reaction vessel and, while stirring, heated to 100°C. Ethylene oxide was bubbled in over a 1.75 hour period at 100°–120°C. The product was then water washed and dried by distilling out residual water and other volatiles under vacuum. The product weighed 519 grams, indicating that 17 grams of ethylene oxide had reacted. This product is itself a very effective ashless dispersant, exhibiting much lower bearing corrosion compared to the Mannich condensation product from which it is made.

Phosphosulfurization

A 200 gram portion of the above ethoxylated product was placed in a reaction vessel and 4 grams of $P_2S_5$ was added to it. This was stired under nitrogen at 100°–120°C for 4 hours. The resultant product was diluted with heptane, water washed and volatiles distilled out under vacuum to give an additive of the present invention.

The above example can be followed using other reactive amines to give similar corresponding products. For example, amines such as N,N-dimethyl-1,3-propanediamine can be used. Likewise, the use of diethanolamine, ethylenediamine, triethylenetetramine, tetraethylenepentamine, dimethylamine, lauryl amine, stearyl amine, phenylenediamine, and the like, lead to useful additives.

In like manner, acetaldehyde, propionaldehyde, butyraldehyde, glyoxal, and the like, can be substituted for formaldehyde with good results.

In place of ethylene oxide other alkylene oxides such as propylene oxide, butylene oxide, and the like, including mixtures thereof, may be used to give useful additives.

EXAMPLE 2

In a reaction vessel was placed 440 grams of the Mannich condensation product from Example 1. While stirring, it was heated to 100°C and ethylene oxide bubbled in for 2 hours. A total of 25 grams of ethylene oxide was consumed. The ethoxylated product was washed and dried by distilling out water and other volatiles under vacuum.

In a second reaction vessel was placed 367 grams of the above ethoxylated product and 7.3 grams of $P_2S_5$. This mixture was stirred under nitrogen at 90°–110°C for 3.5 hours. The product was diluted with heptane and decanted leaving behind a small amount of unreacted $P_2S_5$. The product was water washed and dried by distilling out volatiles, including heptane, under vacuum giving an effective phosphosulfurized additive.

EXAMPLE 3

In a reaction vessel place 200 grams of SAE-7 diluent oil, 940 grams of phenol and 600 grams of polypropylene having an average molecular weight of 1200. Add 40 grams of $BF_3$ phenate and stir at 50°C for 2 hours. Water wash and distill out residual water and volatiles under vacuum. Add 60 grams of N,N-dimethyl-1,3-propanediamine and heat to 50°C while stirring under nitrogen. Add 20 grams of paraformaldehyde and slowly heat to 175°C over a 6 hour period. Apply vacuum when the mixture reaches 150°C, sufficient to aid in water removal. Water wash and dry the mixture by distilling out residual water under vacuum.

While stirring at 75°C, add 75 grams of propylene oxide over a 1.5 hour period using an ice condenser to prevent loss. Stir for an additional hour at 100°C. Water wash and dry the product by vacuum distillation of residual water and other volatiles.

Add 10 grams of $P_2S_5$ and stir under nitrogen at 110°–110°C for 1 hour. Increase temperature to 150°C and stir for 30 minutes. Dilute with heptane and filter. Wash the filtrate with water and distill out volatiles under vacuum to give a useful phosphosulfurized additive.

The above procedures can be followed substituting any of the previously-described phenols, aldehydes, ammonia or amine and alkylene oxides or mixtures thereof to obtain similar additives.

The additives are useful as ashless dispersants in a broad range of lubricating oils, both synthetic and mineral. For example, they may be beneficially used in synthetic ester type lubricating oils such as the $C_{6-10}$ alkanol esters of aliphatic dicarboxylic acids (e.g., adipic, sebacic, and the like) such as, for example, di-2-ethylhexyl sebacate. They may also be used with complex ester lubricants such as those made by the reaction of polyols (e.g., ethyleneglycol, pentaerythritol, trimethylolpropane, and the like), polycarboxylic acids (e.g., adipic, sebacic, and the like), monocarboxylic $C_{4-10}$ aliphatic acids (e.g., hexanoic, octanoic and decanoic, and the like), and monohydric alkanols (e.g., butanol, hexanol, octanol, and the like).

They are also useful in synthetic hydrocarbon oil made by polymerizing olefinically unsaturated hydrocarbons such as styrene, isobutene, butene, hexene, octene, decene, dodecene, and the like. The preferred oils of this type are oligomers of $C_{6-12}$ straight-chain alpha-monoolefins (e.g., decene-1) consisting of a high percentage of trimer. These synthetic oils are preferentially hydrogenated to improve stability. They are also useful in synthetic alkylbenzene oils such as didodecyl benzene, dioctadecyl benzene, and the like.

The additives are most useful in mineral lubricating oils or blends of mineral lubricating oil with synthetic oils. The mineral oils may be refined from any type of base stock including Pennsylvania, midcontinent, Gulf coast, California, and the like.

The amount of dispersant added should be an amount sufficient to impart the required degree of dispersancy and antiwear. A useful range is from about 0.1 to 10 weight percent additive product (i.e., excluding diluent oil in the concentrate). A preferred range is from about 1-5 weight percent.

The lubricating oil may also contain other additives normally included in lubricating oil formulations such as zinc dialkyldithiophosphates, calcium alkarylsulfonates, magnesium alkarylsulfonates, phosphosulfurized olefins (e.g., $P_2S_5$-terpene reaction product), barium salts of phosphosulfurized olefins, V.I. improvers (e.g., polylauryl methacrylates, polybutenes, styrene-butene copolymers, ethylene-propylene copolymers, and the like), antioxidants (e.g., $\alpha$-dimethylamino-2,6-di-tert-butyl-p-cresol, 4,4'-methylenebis(2,6-di-tert-butylphenol) and the like), metal phenates (e.g., barium akylphenates, calcium alkyl phenates, zinc alkylphenates and the like), and other commonly used additives.

The following example illustrates the preparation of a mineral lubricating oil useful in operation of an automotive type internal combustion engine.

EXAMPLE 4

In a blending vessel place 10,000 gallons of SAE-10 mineral lubricating oil. To this add 3 weight percent of the additive of Example 1, 3 weight percent ethylene-propylene copolymer V.I. improver, 0.7 weight percent zinc as zinc dialkyldithiophosphate, 1.3 weight percent overbased calcium alkaryl sulfonate, 0.6 weight percent overbased magnesium alkaryl sulfonate, and 0.3 weight percent 4,4'-methylenebis(2,6-di-tert-butylphenol). Stir until a homogenous solution is obtained resulting in a useful automotive engine lubricant.

Testss were carried out which demonstrate the dispersant properties of the additive. These were L-43 Sludge and Varnish engine tests in which a single cylinder engine is operated using a coolant temperature varying from 120°–200°F and an oil gallery temperature of 150°F. In a standard L-43 test the engine is operated for 180 hours and then disassembled. The various parts are visually rated on a scale from 0–10 (10 equals clean) to give an average sludge and varnish rating. This was modified by periodically disassembling the engine and visually rating the parts until an average rating of 9 was reached. The hours to a No. 9 rating was the test criteria. The test oil was a mineral lubricating oil containing 1.5 weight per cent of a phenolic antioxidant ("Ethyl" Antioxidant 728, Ethyl Corporation trademark) to prevent oxidative failure of the oil. A commercial succinimide-type dispersant was included in one test sample for comparative purposes.

| Additive | Conc. | Hrs. to 9.0 Rating Sludge | Varnish |
|---|---|---|---|
| Example 2 | 4.4% | 104 | 80 |
| commercial disp. | 4.4% | 110 | 34 |

These tests show that the present additives are about equivalent to a commercial dispersant in preventing engine sludge and are substantially more effective in preventing engine varnish.

Further tests were carried out to show the antiwear properties of the present additives. These were standard four-ball wear tests in which a rotating steel ball was placed on top of a triangle of similar fixed-in-place steel balls and rotated at 1800 rpm under a 50 Kg load. The balls were lubricated with mineral oil at 100°C and rotation was continued for 1 hour. The rotating ball wears a circular scar on the three fixed balls. The average scar diameter is a measure of antiwear properties. One sample was included containing the alkoxylted condensation product to give a direct comparison with the same product after phosphosulfurization. In this test a scar diameter under 1 mm is considered pass.

| Additive | Conc. | Scar Dia. (mm) |
|---|---|---|
| base oil | — | 2.83 |
| Example 2 before $P_2S_5$ reaction | 5% | 3.19 |
| Example 2 after $P_2S_5$ reaction | 5% | 0.48 |
| Example 1 | 5% | 0.40, 0.37 |
| Example 1 | 2.5% | 1.06 |

These results show that the present additives are also very effective antiwear agents. Their use in engine lubricating oil should allow much lower concentrations of the ash-forming zinc dialkyldithiophosphates conventionally used to prevent wear.

I claim:

1. An additive having dispersancy and antiwear properties in lubricating oils, said additive being made by the process comprising:

A. reacting 1 mole part of an poly-$C_{2-4}$ olefin substituted phenol wherein said polyolefin substituent has an average molecular weight of from about 650 to 5000 with from about 1–10 mole parts of a $C_{1-4}$ aldehyde and from about 0.1–10 mole parts of a nitrogen compound, said nitrogen compound being selected from the group consisting of ammonia and amines containing at least one HN< group and containing from 1 to about 20 carbon atoms at reaction temperatures to form a Mannich condensation product, B. reacting said condensation product with about 0.1–5.0 mole parts of an alkylene oxide containing from 2 to about 6 carbon atoms to form an akoxylated product, and C. reacting said alkoxylated product with about 0.05 to 1 mole part of $P_2S_5$ at reaction temperature to form said additive.

2. An additive of claim 1 wherein said aldehyde is formaldehyde.

3. An additive of claim 2 wherein said nitrogen compound is an alkylene polyamine.

4. An additive of claim 3 wherein said alkylene polyamine has an average composition corresponding to diethylenetriamine.

5. An additive of claim 4 wherein said alkylene oxide is ethylene oxide.

6. An additive of claim 5 wherein said polyolefin substituent is a polybutene substituent.

7. An additive of claim 5 wherein said polyolefin substituent is a polypropylene substituent.

8. An additive of claim 4 wherein said alkylene oxide is propylene oxide.

9. An additive of claim 8 wherein said polyolefin substituent is a polybutene substituent.

10. An additive of claim 8 wherein said polyolefin substituent is a polypropylene substituent.

11. An additive of claim 2 wherein said nitrogen compound is an N,N,-di-$C_{1-4}$ alkyl lower alkanediamine.

12. An additive of claim 11 wherein said alkanediamine is N,N-dimethyl-1,3-propanediamine.

13. An additive of claim 12 wherein said alkylene oxide is ethylene oxide.

14. An additive of claim 13 wherein said polyolefin substituent is a polybutene substituent.

15. An additive of claim 13 wherein said polyolefin substituent is a polypropylene substituent.

16. An additive of claim 12 wherein said alkylene oxide is propylene oxide.

17. An additive of claim 16 wherein said polyolefin substituent is a polybutene substituent.

18. An additive of claim 16 wherein said polyolefin substituent is a polypropylene substituent.

19. An additive of claim 2 wherein said nitrogen compound is a lower alkanol amine.

20. An additive of claim 19 wherein said alkanol amine is an ethanol amine.

21. An additive of claim 20 wherein said ethanol amine is diethanol amine.

22. An additive of claim 21 wherein said alkylene oxide is ethylene oxide.

23. An additive of claim 22 wherein said polyolefin substituent is a polybutene substituent.

24. An additive of claim 22 wherein said polyolefin substituent is a polypropylene substituent.

25. An additive of claim 21 wherein said alkylene oxide is propylene oxide.

26. An additive of claim 25 wherein said polyolefin substituent is a polybutene substituent.

27. An additive of claim 25 wherein said polyolefin substituent is a polypropylene substituent.

* * * * *